US006314601B1

(12) United States Patent
McClain et al.

(10) Patent No.: US 6,314,601 B1
(45) Date of Patent: Nov. 13, 2001

(54) SYSTEM FOR THE CONTROL OF A CARBON DIOXIDE CLEANING APPARATUS

(76) Inventors: James B. McClain, 8008 Chadbourne Ct., Raleigh, NC (US) 27613; David E. Brainard, 510 E. Cameo La., Knightdale, NC (US) 27545; Michael E. Cole, 2609 Westmill Ct., Raleigh, NC (US) 27613; Steve L. Worm, 4706 St. Thomas Pl., Raleigh, NC (US) 27612

( * ) Notice: Subject to any disclaimer, the term of this patent is extended or adjusted under 35 U.S.C. 154(b) by 0 days.

(21) Appl. No.: 09/405,619

(22) Filed: Sep. 24, 1999

(51) Int. Cl.[7] ..... D06B 39/02

(52) U.S. Cl. ..... 8/158; 68/18 R; 68/18 C; 8/159

(58) Field of Search ..... 68/5 C, 18 R, 68/18 C, 18 F; 8/158, 159

(56) References Cited

U.S. PATENT DOCUMENTS

| | | | |
|---|---|---|---|
| 5,267,455 | 12/1993 | Dewees et al. | 68/5 |
| 5,370,742 | 12/1994 | Mitchell et al. | 134/10 |
| 5,412,958 | 5/1995 | Iliff et al. | 68/5 |
| 5,850,747 | 12/1998 | Roberts et al. | 68/15 |
| 5,937,675 | 8/1999 | Stucker | 68/18 |
| 5,943,721 | 8/1999 | Lerette et al. | 8/158 |
| 5,946,945 | 9/2000 | Kegler et al. | 68/18 R |
| 5,970,554 | 10/1999 | Shore et al. | 8/158 |
| 6,082,150 | 7/2000 | Stucker | 68/18 |
| 6,098,430 | 8/2000 | McClain et al. | 68/18 |

FOREIGN PATENT DOCUMENTS

| | | | |
|---|---|---|---|
| 0 828 020 A2 | 3/1998 | (EP) | D06F/43/00 |
| 0 919 659A2 | 6/1999 | (EP) | D06F/43/00 |
| WO 00/53839 | 9/2000 | (WO) . | |
| WO 97/33031 | 9/1997 | (WO) | D06F/21/04 |
| WO 96/15304 | 5/1996 | (WO) | D06F/43/08 |
| WO 99/13148 | 3/1999 | (WO) | D06F/43/08 |

*Primary Examiner*—Frankie L. Stinson

(57) ABSTRACT

A carbon dioxide dry cleaning apparatus and system for the control thereof is disclosed. The apparatus comprises a wash vessel, a working vessel containing a carbon dioxide cleaning medium and operatively associated with the wash vessel, a pump operatively associated with the wash vessel, a condenser connected to the working vessel, a still operatively associated with the working vessel (which still may be a separate still or incorporated into other system components as explained below), a compressor operatively associated with the wash vessel, and a pressure release valve operatively associated with said working vessel. At least one filter is included in the system, but the filter and still may be consolidated together in a single vessel. The apparatus includes a suitable controller which, operating in association with appropriate valves in the apparatus, provides a system that is used to place the apparatus in a cleaning cycle for washing articles therein, a waking cycle separate from the cleaning cycle during which distillation, recharging and other maintenance and preparatory function can be performed, or a resting cycle or resting state for long term periods of idleness.

24 Claims, 2 Drawing Sheets

SYSTEM FOR THE CONTROL OF A CARBON DIOXIDE CLEANING APPARATUS

FIELD OF THE INVENTION

The present invention concerns washing and dry cleaning apparatus, and particularly concerns dry cleaning apparatus for use with carbon dioxide based dry cleaning systems.

BACKGROUND OF THE INVENTION

Numerous different apparatus for washing garments and fabrics are known. Examples of patents on washing machines include U.S. Pat, No. 1,358,168 to McCutchen, U.S. Pat. No. 1,455,378 to Allen, U.S. Pat. No. 2,357,909 to Ridge, U.S. Pat. No. 2,816,429 to Kurlancheek, and U.S. Pat. No. 3,444,710 to Gaugler. Such apparatus is, in general, adapted to home use with water-based cleaning systems.

Non-aqueous cleaning apparatus, known as "dry cleaning" apparatus, is also known. Dry cleaning employs an organic solvent such as perchloroethylene in place of an aqueous system. Dry cleaning apparatus is not, in general, employed in the home, and is instead situated at a store or central plant. Problems with convention dry-cleaning systems include the toxic nature of the solvents employed.

Carbon dioxide has been suggested as a dry cleaning medium. See, e.g., U.S. Pat. No. 4,012,194 to Maffei. One apparatus is described in U.S. Pat. No. 5,467,492 to Chao et al. This apparatus has apparently been supplanted by the apparatus described in U.S. Pat. No. 5,669,251 to Townsend et al. Townsend describes a dry cleaning system having a hydraulically rotated basket that rests on roller bearings. U.S. Pat. No. 5,267,455 to Dewees et al. describes a dry cleaning system in which carbon dioxide as a cleaning medium is transferred between vessels by means of a second purge gas such as nitrogen. U.S. Pat. No. 5,850,747 to Roberts et al. describes a carbon dioxide cleaning system incorporating a temperature compensating compressor. PCT Application WO 97/33031 to Taricco describes a supercooled fluid temperature controlled cleaning system. None of these references provides a substantial discussion of how to control a carbon dioxide cleaning apparatus.

PCT Application WO 99/13148 to S. Shore describes a dry cleaning system that cycles through eight modes, including a loading (or "idle") mode, a prefill mode, a pressurization mode, a wash mode, a reclaim mode, a vent mode, a make-up mode (or storage fill mode) and a distillation mode. It will be noted from FIG. 3A and FIG. 8 therein that, during the idle mode, numerous valves (including valves 9, 11, 18, 20, 22, 27, 29, 35 and 49) are maintained in a closed position. This creates enclosed areas within the pipes and ancillary vessels of the apparatus. While acceptable for short term periods, it will be readily seen that it is undesireable to create enclosed spaces that are potentially charged with a pressurized gas in such a large industrial apparatus during prolonged periods of idleness (e.g., during night time, holidays, power failures, etc.). The risks of creating such enclosed pressurized chambers are exacerbated if apparatus is then held in an elevated temperature environment, as may well be found in a cleaning plant.

Accordingly, there is a need for improved carbon dioxide cleaning systems that are equipped for periods of sustained idleness or inactivity, whether expected or unexpected, and methods of operating such equipment.

SUMMARY OF THE INVENTION

The present invention provides a method of controlling a carbon dioxide cleaning apparatus. The apparatus comprises a wash vessel, a working vessel containing a carbon dioxide cleaning medium and operatively associated with the wash vessel, a pump operatively associated with the wash vessel, a condenser connected to the working vessel, a still operatively associated with the working vessel (which still may be a separate still or incorporated into other system components as explained below), a compressor operatively associated with the wash vessel, and a pressure release valve operatively associated with said working vessel. At least one filter is included in the system, but the filter and still may be consolidated together in a single vessel. The apparatus includes a suitable controller which, operating in association with appropriate valves in the apparatus, is used to place the apparatus in a cleaning cycle for washing articles therein, a waking cycle separate from the cleaning cycle during which distillation, recharging and other maintenance and preparatory function can be performed, or a resting cycle or resting state for long term periods of idleness. The method of operating the system comprises the steps of:

(a) initiating a cleaning cycle, the cleaning cycle comprising the steps of (i) filling said wash vessel with carbon dioxide cleaning medium from said working vessel, (ii) washing articles to be cleaned in said wash vessel, and (iii) draining said carbon dioxide cleaning medium from said work vessel;

(b) initiating a resting cycle, said resting cycle comprising the steps of placing said condenser, said pump, said still and said filter (when the filter is a separate vessel from the still) in fluid communication with said working vessel and not said wash vessel so that all carbon dioxide cleaning medium in said system is held at a low energy state and ventable through said pressure release valve; and, typically, (c) initiating a waking cycle, said waking cycle typically comprising the steps of removing at least one of said condenser, said pump, said still and said filter from fluid communication with said working vessel. The waking cycle may include a recirculating step for the liquid cleaning medium, and/or a step of emptying carbon dioxide gas from the wash vessel back to the working vessel. The waking cycle can then be followed by the cleaning cycle described above.

Preferably, the rest cycle includes the step of circulating the cleaning medium through at least a portion of the system so that the cleaning medium is kept at a substantially uniform temperature throughout the system, and the constituent ingredients in the cleaning medium are maintained at a substantially uniform concentration throughout the system. Where a recirculating step is not included with the rest cycle, the recirculating step can be carried out at the beginning of the waking cycle as noted above.

An advantage of the resting cycle is that all carbon dioxide in the system is in fluid communication with the working vessel. The door to the wash vessel may be open or closed, but is preferably closed and sealed to provide an additional cooling mechanism as described below. Since the working vessel is in fluid communication with the pressure release valve, liquid carbon dioxide within the system can boil off if the temperature increases and vent (or "burp") through the pressure release valve. Such boiling allows the system to self-cool during periods of sustained idleness, in addition to the other cooling mechanisms described below. Preferably the door to the wash vessel is closed for safety reasons as well. Locking the door during periods of inactivity is a good practice for all enclosures, and also allows one to detect any leaks in the isolation valves that separate the system from the wash tank. This functions as a nightly check on the continuity of the valving.

Thus, a particular aspect of the present invention is a method of cooling a carbon dioxide dry cleaning apparatus between wash cycles or during other periods of inactivity, the apparatus including a wash vessel and a working vessel operatively associated with the wash vessel. The method comprising the steps of:

(a) transferring carbon dioxide cleaning medium from the wash vessel to the working vessel after a wash cycle so that the working vessel contains liquid a cleaning medium comprising carbon dioxide;

(b) opening the wash vessel to remove articles that have been cleaned therefrom; then (c) closing and sealing the wash vessel; and then (d) transferring a portion of the liquid carbon dioxide from the working vessel to the wash vessel as a gas, so that the pressure in the working vessel decreases and the cleaning medium in the working vessel is cooled (which transferring step may be carried out periodically or continuously).

The transferring step (d) may be carried out until the pressure in the wash vessel and the pressure in the working vessel are substantially the same. Once the pressures are substantially the same, an alternate cooling technique can be implemented as described below, or gas in the wash vessel transferred to a condenser where it is condensed and returned to the working vessel as a liquid. Using the condenser in this manner requires activation of the chiller, with accompanying energy costs, but it is still advantageous that the chiller may be inactivated or turned off when the wash vessel is being filled with gas. When necessary, the process may be completed by:

(e) transferring the carbon dioxide gas from the wash vessel (e.g., by passing it through the apparatus condenser to condense the gas and return it to the working vessel as a liquid); and then (f) opening the wash vessel so that articles to be cleaned may be placed therein.

A still further aspect of the present invention is a method of cooling a carbon dioxide dry cleaning apparatus during a wash cycle, the apparatus including a wash vessel, a working vessel operatively associated with the wash vessel, and a condenser operatively associated with the wash vessel and the working vessel. The method comprises the steps of:

(a) transferring carbon dioxide cleaning medium from the working vessel to the wash vessel so that the wash tank contains a liquid cleaning medium comprising carbon dioxide;

(b) initiating a cleaning cycle in the wash vessel; and then (c) transferring (periodically or continuously) a portion of the carbon dioxide from the wash vessel to the condenser as a gas during the cleaning cycle, so that the pressure in the wash vessel decreases and the cleaning medium in the working tank is cooled.

Preferably, but not necessarily step (c) is followed by the steps of:

(d) condensing the carbon dioxide in the condenser to produce liquid carbon dioxide; and then (e) returning the liquid carbon dioxide to either the working vessel or the wash vessel.

The foregoing and other objects and aspects of the present invention are explained in detail in the drawings herein and the specification set forth below.

DETAILED DESCRIPTION OF THE PREFERRED EMBODIMENTS

Figure 1:
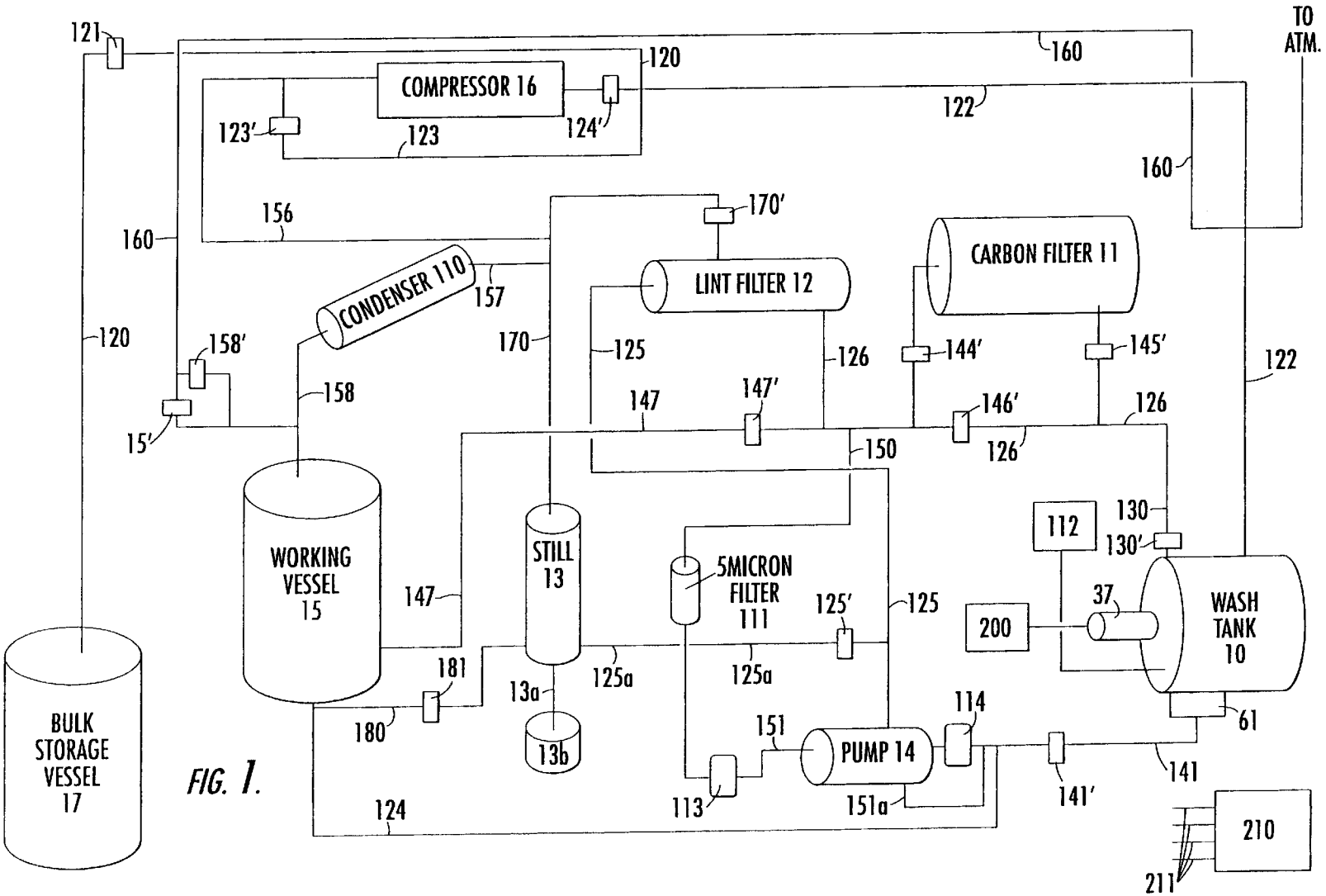
FIG. 1 schematically illustrates an apparatus that incorporates the present invention.
Figure 2:
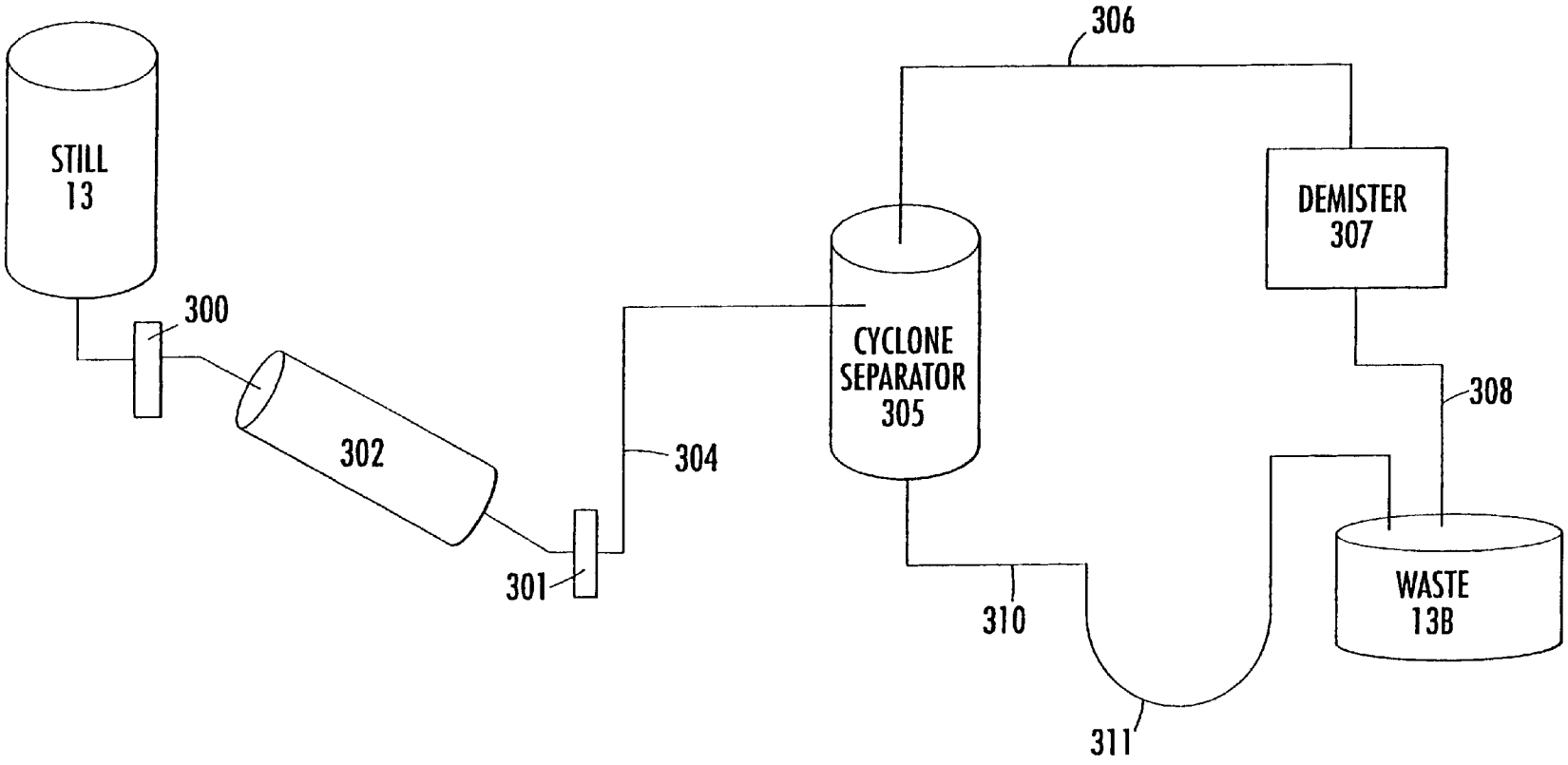
FIG. 2 schematically illustrates a still and waste dump system for incorporation into an apparatus of FIG. 1.

A system that can be used to carry out the present invention is schematically illustrated in FIG. 1. The system includes a wash tank 10, a carbon filter 11, a lint filter 12, a still 13, a pump 14, a working vessel 15, a compressor 16, and a bulk storage vessel 17. A condenser 110, a particulate filter suitable for reducing the flow of damaging particles to the pump such as a 5 micron filter 111, and a vacuum pump 112 (or other suitable fan, blower, edductor or venting mechanism) are also shown. A drive means such as an external motor, internal turbine, internal canned motor or the like is provided for rotating a basket within the wash tank, which basket contains the articles to be cleaned. Valves and lines for carrying out the various stages of operation of the apparatus are also shown, as discussed in greater detail below.

Filter 111 is not absolutely necessary, particularly if the general lint filter 12 is of sufficient capacity and one does not bypass this piece of equipment when the pump is running (for example, it would be bypassed in the event a combined filter is used, when the carbon element of the combined filter is being bypassed). Also, if the pump is designed to handle the particulate load inherent in a dry cleaning machine, then a particulate filter may not be necessary.

The still 13 can be a separate component or vessel as illustrated, or may be incorporated into the wash tank, working tank, pump, filter, or a process pipe. In general, any component that serves to isolate a portion of the cleaning medium, allows heat to be added which causes the vaporization of carbon dioxide to thereby separate the carbon dioxide from other constituents of the medium, and provides for recovery of the vaporized carbon dioxide, can be used as a still. For example, a heating element can be added to a filter vessel so that the filter vessel may be employed as a still.

The canned motor pump 14 contains the canned motor and a turbine pump head driven by the canned motor. The pump is itself enclosed in a pressure vessel. The bearing flush outlet for the canned motor is provided by bearing flush outlet line 151*a*, which is returned to line 141.

Any suitable drive means can be used for as the drive mechanism 200 for rotating the basket within the wash vessel. A turbine drive system may be employed as described in J. McClain et al., commonly owned U.S. patent application Ser. No. 09/047,013 (filed Mar. 24, 1998) (the disclosures of all U.S. Patent Applications cited herein are to be incorporated herein by reference in their entirety). A canned motor pump inside the wash vessel may be employed. An external drive system may be employed, as described in J. McClain et al., commonly owned U.S. patent application Ser. No. 09/306,360 (filed May 6, 1999). An external drive system, in which an external electric motor is connected by a drive belt to a drive shaft directly connected to the rotating basket, with the drive shaft supported by a double mechanical seal as set forth in the aforesaid patent application, is currently preferred. The apparatus preferably includes a system for the controlled addition of detergent formulations, such as an auxiliary vessel connected to the wash vessel via a drain line, with a detergent reservoir connected to the auxiliary vessel, so that detergent can be metered into the auxiliary vessel and the auxiliary vessel emptied into the wash vessel, or a detergent formulation supply line connecting the detergent formulation reservoir to the carbon dioxide cleaning solution supply line that runs to the wash vessel. Either or, preferably both, such injection or addition systems are included in the apparatus, as disclosed in commonly owned, copending U.S. Patent Application of DeYoung et al., Ser. No. 09/312,556 (filed May 14, 1999), the disclosure of which is incorporated by reference herein in its entirety.

The apparatus of the present invention may incorporate methods for conserving vapor, rinse tanks and methods, and further cooling methods, as described in commonly owned application of D. Brainard, J. McClain, M. Cole, and S. Worm, Methods and Apparatus for Conserving Vapor and Collecting Liquid Carbon Dioxide for Carbon Dioxide Dry Cleaning, Ser. No. 08/404,957 (attorney Docket no. 5697-26)(filed concurrently herewith), the disclosure of which is incorporated by reference herein in its entirety.

A programmable logic controller 210 serves as a control means and is operatively associated with the valves via suitable pneumatic or electric lines 211, or the like (not shown for clarity) to provide the valve configurations needed to achieve the cycles described below. All other system components can be controlled by suitable pneumatic or electric lines or the like from the controller 210 in like manner. Preferred is an Allen Bradley SLC500 programmable logic controller (PLC), which is programmed using the A/B programming language in accordance with known techniques. The particular control means used is not critical, and can be implemented with a any of a variety of different hardware, software, and combination hardware/software systems, including a variety of different computers, interface boards, or program languages, numerous of which are known to persons skilled in the art.

It is necessary to maintain proper temperature of the liquid $CO_2$ cleaning medium in the dry cleaning machine in order to prevent the pressure within the machine from exceeding its design limit and prevent temperature related degradation or separation of detergent cosolvent that is mixed together with the liquid $CO_2$. Preferably the temperature is maintained at or below ambient temperature, and most preferably the temperature is maintained below ambient temperature (most preferably at a temperature between about 55 to about 62° F.).

In order to maintain the liquid $CO_2$ within the dry-cleaning machine at a temperature that is at or below ambient temperature, it is necessary to remove heat from the fluid either continuously or at regular intervals. This cooling must take place both when the dry-cleaning machine is in operation as well as when the machine is in "rest state" at which time the machine is not washing but is sitting idle. Currently, the liquid $CO_2$ is preferably cooled by at least two methods:

Direct Heat Exchange. By circulating the liquid $CO_2$ cleaning medium through a liquid to liquid heat exchanger using the pump, the heat is exchanged with a coolant which is itself kept cool via. a chiller. This method of cooling can be used to remove heat from the liquid $CO_2$ either when the machine is washing or when it is in the rest state. The capacity of the heat exchanger may be too low to remove a significant amount of heat from the system, but this heat exchanger can be increased in capacity to provide significant cooling.

Batch Vaporization During Washtank Pressurization. Heat is removed from the liquid $CO_2$ during the pressurization portion of the dry-cleaning cycle where some of the liquid $CO_2$ in the working tank is vaporized and transferred to the washtank in order to bring the wash tank up to operating pressure. The product of the mass boiled vs. heat of vaporization gives the total amount of heat removed from the liquid $CO_2$. The amount of heat that is removed in the course of this process can be large enough that heat must be added back into the liquid $CO_2$ using a liquid to steam heat exchanger, where heat may be transferred to the to liquid $CO_2$ from a steam source.

The heat that is removed from the liquid $CO_2$ in the course of this "batch" vaporization process is eventually transferred to the coolant during the vapor recovery part of the cycle in which the gaseous $CO_2$ in the wash tank is compressed using a compressor and directed to a condenser where the gas is condensed back into a liquid thereby releasing the heat of vaporization to the coolant.

One problem with this method of cooling is that when the ambient temperature around the machine is high, the temperature of the liquid $CO_2$ may increase significantly during the course of the washing portion of the cycle. Even though the liquid may start the wash portion of the cycle at the proper temperature owing to the heat removed during the vaporization portion of the cycle as described above, the amount of heat transferred from the ambient through the washtank to the liquid during the wash portion of the cycle can be enough to increase the liquid temperature above allowable limits. This fact requires that the heat exchanger be sized to provide sufficient cooling under these circumstances, dictating a larger (and more expensive) heat exchanger than would otherwise be required.

Vaporization During Machine Rest. When the machine is in rest state as discussed below, the working tank has a gas side connection to the condenser. When coolant is passed through the condenser, gaseous $CO_2$ will condense in the condenser and travel by gravity as a liquid back to the working tank. This condensation causes the pressure in the working tank to drop and this causes some of the liquid in the working tank to vaporize and thereby remove heat from the remaining liquid. This method of removing heat from the liquid in the working tank during the rest state can be continued indefinitely. However, the chiller must be operating continuously throughout the course of this process and it is therefore consuming electricity even thought is operating at only a fraction of its capacity at this time. Additional cooling processes, as discussed below, can be used to render the operation more energy efficient.

1. The Cleaning Cycle.

A. The filling step. Articles to be cleaned are placed in the wash vessel through an open door and the door closed and sealed. The wash tank is then initially charged with carbon dioxide gas to about 50 psi at ambient temperature from bulk storage vessel 17 via line 120 through valve 121 to line 122 into wash tank 10.

To fill the wash tank (which preferably has a capacity of 100 to 150, and most preferably 145, gallons and is filled half-way with liquid carbon dioxide cleaning medium), liquid carbon dioxide cleaning medium is pumped from working vessel 15 through line 124 to pump 14, and then by line 125 through lint filter 12 and line 126 and into the wash tank through line 130 and valve 130'. Gas-side communication between working vessel 15 and wash tank 10 is provided via line 122 and 123 through valves 123', and then by line 156 and 157 through condenser 110 and by line 158 to working vessel 15.

B. The washing step. Once the filling step is completed the wash cycle can be initiated. During the wash cycle, liquid medium is drained from the wash tank 10 via drain line 141 to pump 14, and then through line 135 to the lint filter and into the wash tank as during the fill step. During the first period of the wash cycle (typically about two minutes) valves 14' and 145' are closed and valve 146' is open so that the carbon filter is locked out of the cycle. Sizing, coatings, bleach, whiteners and the like are usually added at this point in the cleaning cycle This prevents soap elements and other elements in the cleaning medium from initially adhering to and being trapped within the carbon filter. After the initial period, vales 14' and 145' are opened and valve 146' is closed, and the liquid medium is thereby passed through the carbon filter 11 before being returned to the wash tank 10.

The lint filter is preferably a bag filter, and is separate from the carbon filter. However, the choice of filtering mechanism is not critical, and different filters can be employed, the filters can be consolidated together, etc. It will be appreciated that valves or other flow control means should be provided so that the carbon filter can be bypassed on occasion, such as during the addition of detergent, so that freshly added detergent is not immediately removed from the cleaning medium by the carbon filter.

C. The draining step. After the wash step, the liquid medium is drained from the wash tank by closing valve 146' and opening valve 147'so that liquid medium pumped through the lint filter is returned by line 147 to working vessel 15. Importantly, liquid should be drained just out of the wash tank (e.g., to about the level of the drain 61), so that the pump will not be run dry or cavitate and be damaged. The level of the liquid carbon dioxide cleaning medium can be determined by using indicators or switches based on capacitance, conductance, differential pressure, optoelectronics, fiber optics, sonics, ultrasonics, visual observation, float level, magnetic switches, by using a flow meter, strain guage or weigh cell to calculate the amount of fluid being transported, etc. For example, a weigh cell could be used on either the tank the fluid is going into or the tank from which the fluid is leaving to determine when to stop transfer of fluid. One could use the weigh cell primarily, especially if one leaves a liquid heel in the working tank to provide a "buffer zone" for the weigh cell to stop the pump without completely running the pump dry.

After initial draining, valve 147' is closed, the pump is turned off, and the inner basket, which is perforated, rotated or spun at about 150 to 350 revolutions per minute for from 1 to 3 minutes. This extraction step removes excess liquid medium from the articles within the basket.

After the spin cycle or extraction step, liquid medium is further pumped from the wash vessel to a level below the rotating basket, and preferably below valve 141', and returned to the working vessel. Liquid is drained below valve 141' to remove as much liquid as possible from the wash tank, so that when the wash tank is depressurized to remove the clothes there is minimal boiling of the wash fluid, as boiling in turn dramatically chills the wash tank and the clothes. Since a significant amount of carbon dioxide remains in the wash tank as a relatively high pressure gas (e.g., 200 or 300 psi to 500 or 900 psi; or stated otherwise, at vapor pressure or up to 100 psi below vapor pressure for the gas at the temperature of the system in wash tank 10), valve 141' is closed to isolate the wash tank, valve 123' is closed, valve 12' is opened, and gas within wash tank 10 is pumped by compressor 16 out line 156 to line 157 and through the condenser 110 and back into the working vessel by line 158. Valve 158' is closed for this step, and valve 15' is a pressure release valve to vent header line 160. Valve 141' is preferably a ball valve.

2. The Resting Cycle.

The resting cycle can be initiated: (1) manually by operator control; (2) automatically after a period of sustained idleness, such as lack of input to the controller by an operator for a period of 30 or 60 minutes; (3) manually upon detection of valve mismatch and the delivery of an audio and/or visible signal such as on a controller that a valve mismatch has occurred; or (4) automatically in the event of a power failure after a predetermined time (e.g., 30 minutes) or manually by an operator).

A "valve mismatch" is an event that occurs when one or more valves in the system are configured (i.e., open or closed) in a manner that is not indicated by any of the programming of the controller, or does not accomplish any of the predefined tasks of the system. (i.e., is a valve configuration that is not present in a predefined list or set of permitted valve configurations contained within the controller). Valve mismatches are detected by including limit switches on the valves and providing the information back to the program logic controller, which is programmed to detect impermissible combinations. When a valve mismatch is detected, the controller automatically causes the system to deliver a mismatch signal and go into a mismatch state to wait for further instructions from the operator, the operator can manually switch the system to a resting state.

All valves in the system are mechanically biased so that, in the event of a power failure or the like, the system automatically enters the resting cycle after a predetermined time (e.g., thirty minutes). Of course, the power must come back on for the system to take further action.

If a power failure or surge, valve mismatch or the like occurs during a fill, wash or drain step, the program automatically switches the system to the drain step if liquid cleaning medium is in the wash vessel. If liquid cleaning medium is not detected in the wash vessel (e.g., by means of a pressure sensor), then the system automatically goes to vapor recovery or vent, depending upon the pressure within the wash vessel (with higher pressures favoring vapor recovery).

Temperature control An important function during the resting step is to control the temperature of the cleaning system for both performance and safety reasons. The present invention incorporates three different temperature control techniques, as described below. These techniques can be carried out in the order specified below, or any combination or permutation thereof.

As a first means for cooling the system, the controller can require the wash tank door to be closed and sealed at the beginning of the rest cycle. In this case, the wash tank at the beginning of the rest cycle is at relatively low pressure, preferably atmospheric pressure. The wash tank will likely be at atmospheric pressure at this point because the last action on the machine prior to rest will be removal of a load of clothes, although it could also be drawn down to be at a vacuum. Cooling can then be carried out in an inexpensive manner by simply venting carbon dioxide as a gas from the working vessel into the wash tank, this can continue until the chill caused by the heat of vaporization is sufficient to lower the temperature (therefore pressure) of the contents of the working tank. This can continue until the gas pressure in the wash tank is substantially the same as the gas pressure in the working vessel. This technique is most economical and preferably takes priority over the other cooling techniques described below.

As a supplemental means for cooling the system, gas in the wash tank can be compressed through compressor 16 and condenser 110 back into the working vessel, and then wash tank will again be available for gas expansion and the cooling of the working vessel as described above.

As a still further means for cooling the system, the condenser 110 is activated upon detection of a temperature increase in the working vessel 15. This manner of cooling is less economical than that described above, but still preserves the carbon dioxide gas in the system.

Finally, the system can be cooled by simply allowing carbon dioxide gas to periodically vent, or "burp" from the working vessel through the back pressure release valve. Since this results in the loss of carbon dioxide from the cleaning medium, this cooling means is preferably implemented only when the cooling means described above are not available (e.g., the wash tank is full, and/or a power failure or other fault has occurred that precludes use of the condenser).

Recirculation. During rest, or in between cleaning cycles as the apparatus sits idle, the heat input at various locations within the system can vary even though overall temperature is controlled as described above, and the behavior of various ingredients (e.g., detergents) at various locations within the system can vary, particularly if boiling occurs within the system at locations having relatively high input during the rest cycle. Accordingly, the rest cycle preferably includes a recirculation step, in which the cleaning medium is at least periodically pumped from the working vessel through the pump, filter or filters, and back to the working vessel. The recirculation step is preferably performed immediately upon entering the rest state, and then every 60 minutes during the rest state. This recirculation step mixes the cleaning medium and rebalances the concentration of the cleaning medium constituents throughout the system. If not carried out during the resting state as preferred, the recirculation step should then at least be carried out at the beginning of the waking cycle as described below.

3. The Waking Cycle.

The waking cycle is identified as a separate cycle from the washing cycle for the purpose of convenience, and to better enumerate the functions that are performed by the apparatus separately from the washing cycle and resting cycle, including the distillation cycle. The waking cycle is initiated manually by operator control through the programmable logic controller. The waking cycle is the action/cycle/state into which the machine goes when leaving the rest state, and is also the state in which the machine resides between normal cycles (e.g., multiple wash cycles).

If cleaning medium has not been recirculated during the resting cycle as described above, then recirculation may be carried out at the beginning of the waking cycle. Preferably, the recirculation step is carried out periodically during the rest cycle rather than at the beginning of the waking cycle.

If the wash tank contains carbon dioxide gas under pressure at the beginning of the wake up cycle (transferred from the working vessel for the purpose of cooling the working vessel during the resting state), then the carbon dioxide gas is returned to the working vessel by activation of the compressor 16 through condenser 110, and any remaining carbon dioxide vented, before the programmable logic controller permits the wash tank door to be opened so that the wash tank can be filled with articles to be cleaned, the door closed, and the cleaning cycle initiated.

The distillation cycle. Still 13 is filled with 8 to 10 gallons of liquid medium by draining the contents of lint filter 12 through line 125 through valve 125' and line 125*a*, or by draining from the working vessel 15 through line 180 and through valve 181 (or the contents of the lint filter can be drained from the lint filter to the working vessel through these lines and through the still). Gas-side communication is provided between the still and the lint filter through line 170 by opening valve 170'. The still is activated and distilled carbon dioxide gas passes by line 170 to line 157 (valve 170 has been closed) and condenser 110 to line 158 and working vessel 15. Waste is drained from still 13 by line 13*a* into waste receptacle 13*b* as explained in greater detail below.

It will be appreciated that the still can be filled from any liquid source. The still can be filled during the wash step, and can even be filled continuously, as described in U.S. Pat. No. 5,937,675 to Strucker.

Because still 13 is open to the condenser, the still is at system pressure (approximately 750 to 770 psig) even at the end of the distillation cycle. The end of the distillation cycle is detected when a marked temperature increase in the still is detected, signifying the last portion of carbon dioxide being boiled off of the contents thereof. At this point, the programmed logic controller is programmed so that the steam or other heat supply to the still is turned off, and valve 300 is opened while valve 301 remains closed. As a result, the remaining liquid contents of the still is injected into the expansion chamber 302, which is at atmospheric pressure and which has a volume of approximately 0.15 gallons. After a predetermined time (approximately ten seconds) valve 300 is closed and valve 301 is opened. The liquid contents of the expansion chamber is then injected through a constrained flow line 304 into a cyclone separator 305. Gas from the separator is directed along line 306, which is coupled to bag demister 307, which is provided with a drain line 308 to waste receptacle 13b. Liquid from the cyclone separator is directed along line 310 through U-trap 311 and into the waste receptacle 13*b*.

In the foregoing apparatus, suitable chilling can be provided by a chiller such as a glycol chiller system or chilled fluid supply, which is typically a traditional refrigeration unit with a bath, evaporative cooler, or the like, coupled with a heat exchanger or heat exchangers (typically spiral wound shell and tube heat exchangers), in accordance with conventional techniques, or any other heat exchange system that reduces the temperature of the medium. Suitable pressure release valves are incorporated into the system for all pressure vessels in accordance with standard safety protocols.

The chiller may be physically attached to the framework or skid that supports the dry cleaning apparatus, or may be provided as a separate, stand-alone unit. Currently preferred is a Model Number HOO15, OOOPR-L-M stand-alone chiller from Koolant Koolers Inc., 2625 Emerald Drive, Kalamazoo Mich. 49001. The program logic controller 210 may be operatively associated with the chiller to provide a way to best meet the instantaneous demands of the dry cleaning apparatus. Since the chill demand is fairly low for a considerable time, but quite high for a small portion of the time during the dry cleaning process, energy can be conserved by activating the chiller only during the times required as indicated herein. In still another embodiment, a "dumb chiller" that is always on can be used to meet continuous chilling needs, and a "smart" chiller that is controlled by the program logic controller can be provided to meet transient chilling needs.

4. Cleaning Compositions and Articles to be Cleaned.

Articles that can be cleaned by the apparatus of the present invention are, in general, garments and fabrics (including woven and non-woven) formed from materials such as cotton, wool, silk, leather, rayon, polyester, acetate, fiberglass, furs, pelts, canvas, neoprene, etc., formed into items such as clothing, work gloves, tents, parachutes, sails, hats, tapestry, waders, rags, leather goods (e.g., boots, shoes, handbags and brief cases), etc.

Any carbon dioxide liquid dry-cleaning composition can be used as the medium in the instant apparatus. See, e.g., U.S. Pat. No. 4,012,194 to Maffei. In the instant apparatus, carbon dioxide is supplied by tank 17, and additional ingredients can be added to the carbon dioxide in the working vessel (which may optionally be supplied with a stirrer to serve as a mixing means therein), in the wash tank, or any other suitable location in the system (or combination thereof). In a preferred embodiment, the liquid dry-cleaning medium comprises a mixture of: (a) carbon dioxide, (b) optionally but preferably water, (c) surfactant, and, (d) optionally but preferably an organic co-solvent. After the contacting step, the article is separated from the liquid dry cleaning composition. Preferably, the liquid dry cleaning composition is at ambient temperature, of about 0° C. to 30° C. In one embodiment; the surfactant contains a $CO_2$-philic group; in another embodiment, the surfactant does not contain a $CO_2$-philic group. A single surfactant may be used, or a combination of surfactants may be used. Numerous surfactants are known to those skilled in the art. Examples are given in U.S. Pat. No. 5,858,022 to Romack et al., U.S. Pat. No. 5,676,705 to Jureller et al., U.S. Pat. No. 5,683,473 to Jureller et al., and U.S. Pat. No. 5,683,977 to Jureller et al. The disclosures of all United States Patent references cited herein are to be incorporated herein by reference.

As will be apparent to those skilled in the art, numerous additional ingredients can be included in the dry-cleaning medium, including detergents, bleaches, whiteners, softeners, sizing, starches, enzymes, hydrogen peroxide or a source of hydrogen peroxide, fragrances, etc. The liquid dry cleaning composition is preferably provided in an amount so that the wash tank contains both a liquid phase and a vapor phase (that is, so that the drum is not completely filled with the article and the liquid composition).

The foregoing is illustrative of the present invention, and is not to be construed as limiting thereof. The invention is defined by the following claims, with equivalents of the claims to be included therein.

That which is claimed is:

1. A method of controlling a carbon dioxide cleaning apparatus, said apparatus comprising a wash vessel, a working vessel containing a carbon dioxide cleaning medium and operatively associated with said wash vessel; a pump operatively associated with said wash vessel; a condenser connected to said working vessel; a still operatively associated with said working vessel, a compressor operatively associated with said wash vessel, and a pressure release valve operatively associated with said working vessel;

said method comprising the steps of:

(a) initiating a cleaning cycle, said cleaning cycle comprising the steps of (i) filling said wash vessel with carbon dioxide cleaning medium from said working vessel, (ii) washing articles to be cleaned in said wash vessel, and (iii) draining said carbon dioxide cleaning medium from said work vessel; and then (b) initiating a resting cycle, said resting cycle comprising the steps of placing said condenser, said pump, and said still in fluid communication with said working vessel and not said wash vessel so that all carbon dioxide cleaning medium in said system is held at a low energy state and ventable through said pressure release valve.

2. A method according to claim 1, wherein step (b) is followed by the step of:

(c) initiating a waking cycle, said waking cycle comprising the steps of removing at least one of said condenser, said pump, said still or said compressor from fluid communication with said working vessel; and then repeating step (a) above.

3. A method according to claim 2, wherein said step of initiating said waking cycle includes the step of circulating said cleaning medium through at least a portion of said apparatus so that said cleaning medium is kept at a substantially uniform temperature therein.

4. A method according to claim 1, said apparatus further comprising a filter; wherein said filter is in fluid communication with said working vessel during said resting state.

5. A method according to claim 4, wherein said filter and said still are contained in separate vessels.

6. A method according to claim 4, wherein said filter and said still are contained in a common vessel.

7. A method according to claim 1, wherein said resting cycle includes the step of circulating said cleaning medium through at least a portion of said apparatus so that said cleaning medium is kept at a substantially uniform temperature therein.

8. A method according to claim 1, wherein said resting cycle includes the step of cooling said cleaning medium in said working vessel.

9. A method according to claim 8, wherein said cooling step is carried out by venting carbon dioxide gas from said working vessel to said wash vessel.

10. A method according to claim 8, wherein said cooling step is carried out by activating said condenser.

11. A method according to claim 8, wherein said cooling step is carried out by venting carbon dioxide gas from said working vessel to the atmosphere through said pressure release valve.

12. A method according to claim 8, wherein said cooling step is carried out by (a) venting carbon dioxide gas from said working vessel to said wash vessel; and then (b) activating said condenser; and then (c) venting carbon dioxide gas from said working vessel to the atmosphere through said pressure release valve.

13. A carbon dioxide cleaning apparatus, said apparatus comprising a wash vessel, a working vessel containing a carbon dioxide cleaning medium and operatively associated with said wash vessel; a pump operatively associated with said wash vessel; a condenser connected to said working vessel; a still operatively associated with said working vessel, a compressor operatively associated with said wash vessel, and a pressure release valve operatively associated with said working vessel; said apparatus further comprising (a) means for initiating a cleaning cycle, said cleaning cycle comprising the steps of (i) filling said wash vessel with carbon dioxide cleaning medium from said working vessel, (ii) washing articles to be cleaned in said wash vessel, and (iii) draining said carbon dioxide cleaning medium from said work vessel; and (b) means for initiating a resting cycle, said resting cycle comprising the steps of placing said condenser, said pump, and said still in fluid communication with said working vessel and not said wash vessel so that all carbon dioxide cleaning medium in said system is held at a low energy state and ventable through said pressure release valve.

14. An apparatus according to claim 13, further comprising:

(c) means for initiating a waking cycle, said waking cycle comprising the steps of removing at least one of said condenser, said pump, said still or said compressor from fluid communication with said working vessel.

15. A method of cooling a carbon dioxide dry cleaning apparatus between wash cycles or during other periods of inactivity, said apparatus including a wash vessel and a working vessel operatively associated with said wash vessel; said method comprising the steps of:

(a) transferring carbon dioxide cleaning medium from said wash vessel to said working vessel after a wash cycle so that said working vessel contains liquid a cleaning medium comprising carbon dioxide;

(b) opening said wash vessel to remove articles that have been cleaned therefrom; then (c) closing and sealing said wash vessel; and then (d) transferring a portion of said liquid carbon dioxide from said working vessel to said wash vessel as a gas, so that the pressure in said working vessel decreases and said cleaning medium in said working vessel is cooled.

16. A method according to claim 15, wherein said transferring step (d) is carried out periodically.

17. A method according to claim 15, wherein said transferring step (d) is carried out continuously.

18. A method according to claim 15, wherein said transferring step (d) is carried out until the pressure in said wash vessel and the pressure in said working vessel are substantially the same.

19. A method according to claim 15, further comprising the step of:

(e) transferring said carbon dioxide gas from said wash vessel; and then (f) opening said wash vessel so that articles to be cleaned may be placed therein.

20. A method according to claim 19, wherein said transferring step (e) is carried out by transferring said carbon dioxide gas from said wash vessel to said working vessel.

21. A method of cooling a carbon dioxide dry cleaning apparatus during a wash cycle, said apparatus including a wash vessel, a working vessel operatively associated with said wash vessel, and a condenser operatively associated with said wash vessel and said working vessel; said method comprising the steps of:

(a) transferring carbon dioxide cleaning medium from said working vessel to said wash vessel so that said wash tank contains a liquid cleaning medium comprising carbon dioxide;

(b) initiating a cleaning cycle in said wash vessel; and then (c) transferring a portion of said carbon dioxide from said wash vessel to said condenser as a gas during said cleaning cycle, so that the pressure in said wash vessel decreases and said cleaning medium in said working tank is cooled.

22. A method according to claim 21, wherein said step (c) is followed by the steps of:

(d) condensing said carbon dioxide in said condenser to produce liquid carbon dioxide; and then (e) returning said liquid carbon dioxide to either said working vessel or said wash vessel.

23. A method according to claim 21, wherein said step (c) is carried out periodically during said cleaning cycle.

24. A method according to claim 21, wherein said step (c) is carried out continuously during said cleaning cycle.

* * * * *